US007514652B2

(12) United States Patent
Elnar

(10) Patent No.: US 7,514,652 B2
(45) Date of Patent: Apr. 7, 2009

(54) SPA WITH CIRCUIT FOR DETECTING EXCESSIVE GROUND CURRENT

(76) Inventor: Joseph G. Elnar, 12579 Canyon Wind Rd., Riverside, CA (US) 92503

( * ) Notice: Subject to any disclaimer, the term of this patent is extended or adjusted under 35 U.S.C. 154(b) by 135 days.

(21) Appl. No.: 11/601,414

(22) Filed: Nov. 16, 2006

(65) Prior Publication Data

US 2007/0108185 A1 May 17, 2007

Related U.S. Application Data

(60) Provisional application No. 60/737,664, filed on Nov. 16, 2005.

(51) Int. Cl.
*H05B 1/02* (2006.01)

(52) U.S. Cl. ..... 219/481; 219/497; 219/494; 4/541.1

(58) Field of Classification Search ..... 219/494, 219/497, 501, 506, 499; 4/541.1, 541.6; 340/635

See application file for complete search history.

(56) References Cited

U.S. PATENT DOCUMENTS

| | | | | |
|---|---|---|---|---|
| 5,526,538 | A | 6/1996 | Rainwater | |
| 6,747,367 | B2 * | 6/2004 | Cline et al. | 307/11 |
| 6,976,052 | B2 * | 12/2005 | Tompkins et al. | 709/201 |
| 7,018,800 | B2 * | 3/2006 | Huisenga et al. | 435/6 |
| 7,236,692 | B2 * | 6/2007 | Tran | 392/318 |
| 2002/0038169 | A1 * | 3/2002 | Cline et al. | 700/275 |
| 2008/0094235 | A1 * | 4/2008 | Brochu et al. | 340/635 |

* cited by examiner

*Primary Examiner*—Mark H Paschall
(74) *Attorney, Agent, or Firm*—Kenneth L. Green; Edgar W. Averill, Jr.

(57) ABSTRACT

A spa heater/control includes sensors and processors to monitor and display indicia of common failures. The heater/control includes voltage sensors and processing to measure proper power connections to the heater/control. The spa heater/control further monitors various voltages, currents, flow rates, and temperatures within the spa to provide diagnostic information which is easily obtained by a spa owner to provide to a spa dealer to reduce the time and cost of spa repairs.

12 Claims, 6 Drawing Sheets

SPA WITH CIRCUIT FOR DETECTING EXCESSIVE GROUND CURRENT

The present application claims the benefit of U.S. Provisional Application Ser. No. 60/737,664, filed Nov. 16, 2005, which application is incorporated herein by reference.

BACKGROUND OF THE INVENTION

The present invention relates to spa heaters and controls and in particular to a spa heater/control with improved monitoring and reporting functions to reduce maintenance time and costs.

Spas are commonly owned and used at residences throughout the world. Such spas generally comprise a tub for bathers to reside in, pump for circulating water, jets or nozzles for directing the water into the spa, and a heater for heating the water. The heaters are often 220 volt heaters requiring a specific connection of power wires, and unfortunately, electricians performing home installations of such spas mis-connect the power wires or run an electrical service to too great a resistance, resulting in heater failure. Such failures generally result in unnecessary service calls, and returns of properly performing spa heaters and/or spa controls due to wiring errors.

Known spas also include Groung Fault Isolator (GFI) circuits which sense current leaking to ground, such as from a failed electrical heater element, and turn off all power to the spa when the current leakage exceeds a low threshold. Unfortunately, power to pumps is also removed, and in the absence of at least a minimum circulation, the chance of water freezing in lines is increased and significant damage may result.

Additionally, spas have been known to hold children against drains with severe consequences.

BRIEF SUMMARY OF THE INVENTION

The present invention addresses the above and other needs by providing a spa heater/control which includes sensors and processors to monitor and display indicia of common failures. The heater/control includes voltage sensors and processing to measure proper power connections to the heater/control. The spa heater/control further monitors various voltages, currents, flow rates, and temperatures within the spa to provide diagnostic information which is easily obtained by a spa owner to provide to a spa dealer to reduce the time and cost of spa repairs In accordance with one aspect of the invention, there is provided a spa heater/control comprising electric terminals, at least one circuit connected to two of the terminals for measuring a voltage between two of the terminals, and a display connected to the at least one circuit for displaying the voltage between two of the terminals. The electrical terminals receive electrical power for heating water. The terminals comprise a positive terminal, a common terminal, and a negative terminal. The ability to easily observe the voltages on the terminals allows simple and quick verification of correct power connects.

In accordance with another aspect of the invention, there is provided a heater/control including a heater assembly having a heater manifold containing heater elements and current collectors. The current collector spirals out from the center of a flow of water through the heater manifold. A control circuit is electrically connected to the heater assembly and a current sensing circuit in the control circuit measures a ground current collected from the flow of water by the current collector. A comparing circuit comparing the measurement of the ground current to a first threshold for detecting an excessive ground current. Preferably, the current collector is a three dimensional helix both spiraling out radially from the center of the heater manifold and stretching axially as it spirals outward.

In accordance with an additional aspect of the invention, there is provided a method for controlling a spa heater. The method includes measuring a ground current collected by a current collector in a flow of water through a heater, comparing the ground current measurement to a first threshold, and removing power from heater elements in the heater if the ground current measurement exceeds the first threshold before a system Ground Fault Isolator (GFI) removes power from a water circulation pump providing circulation of water through the heater. Preferably, power is removed from the heating elements if the ground current exceeds approximately 3.5 milliamps.

In accordance with yet another aspect of the invention, there is provided a method for controlling a spa to prevent injury. The method includes measuring a normal current draw of a spa pump, storing the measured current draw, comparing the stored current draw to the present current draw of the pump, and turning the pump off if the present current draw is substantially less than the stored current draw. Preferably, the pump is turned off if the current draw is reduced by at least approximately 40 percent of the normal current draw.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
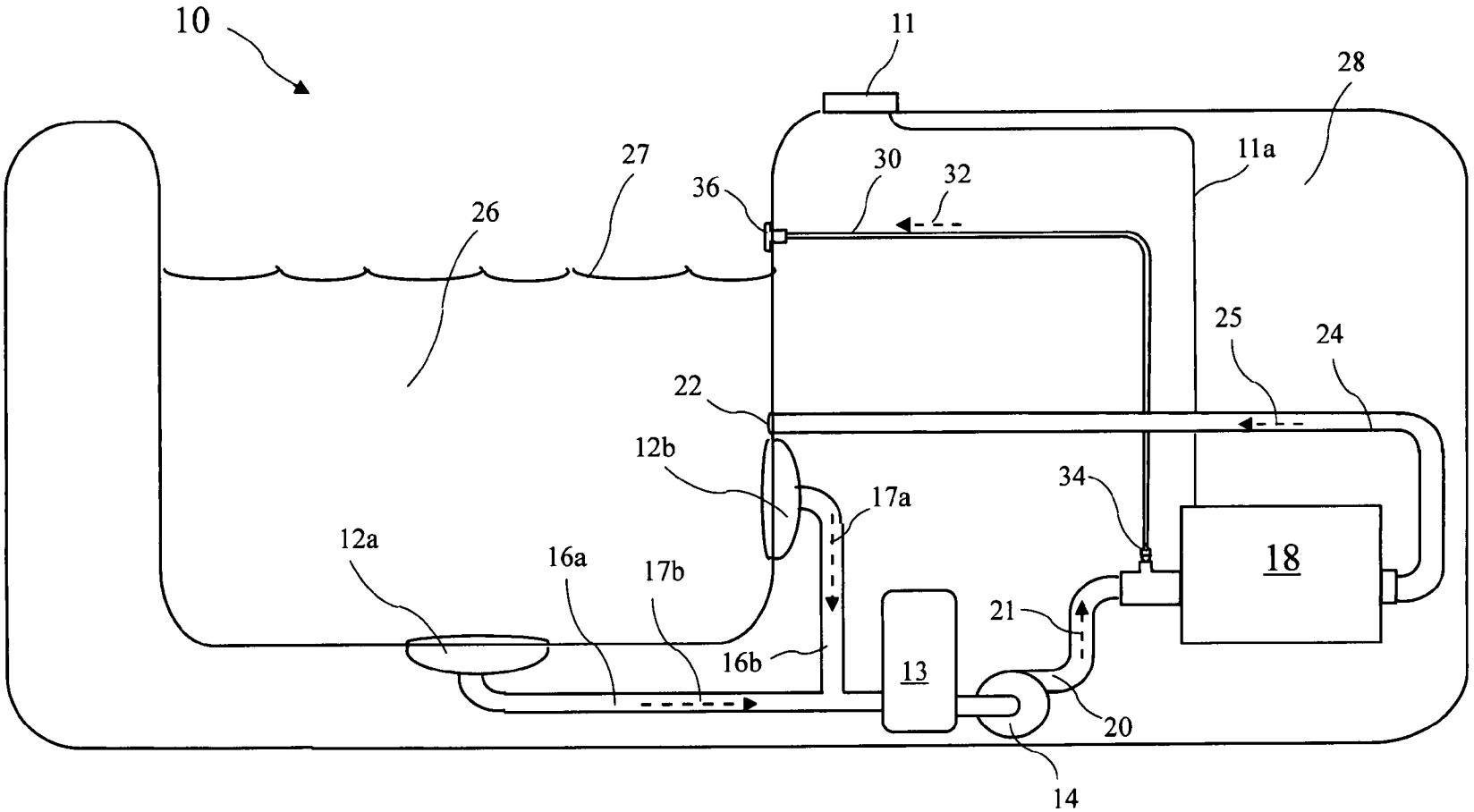
FIG. 1 is a spa including a spa heater/control according to the present invention.

A spa 10 is shown in FIG. 1. The spa 10 includes drains 12*a* and 12*b*. The drains 12*a*, 12*b* are in fluid communication with a pump 14 through first lines 16*a* and 16*b* respectively carrying flows 17*a* and 17*b* respectively and through a filter 13. A spa heater/control 18 is in fluid communication with the pump 14 through second line 20 carrying second flow 21. A spa-side control 11 is electrically connected to the spa heater/control 18 by control wires 11*a* for controlling the spa 10, or may be wirelessly connected to the spa heater/control 18. The heater/control 18 is in fluid communication with at least one jet 22 through line 24 carrying a third flow 25. Water 26 is thereby circulated and heated. An automatic air bleed valve 34 is connected to an inlet of the heater/control 18 to bleed air from the line 20. A hose 36 carries a sixth flow 32 from the automatic air bleed valve 34 to a hose connector 36 mounted to the wall of the spa 10. A automatic air bleed valve is described in U.S. Pat. No. 7,025,079 for "Air Bleed-Off Valve" filed by the inventor of the present invention. The '079 patent is herein incorporated by reference.

Figure 2A:
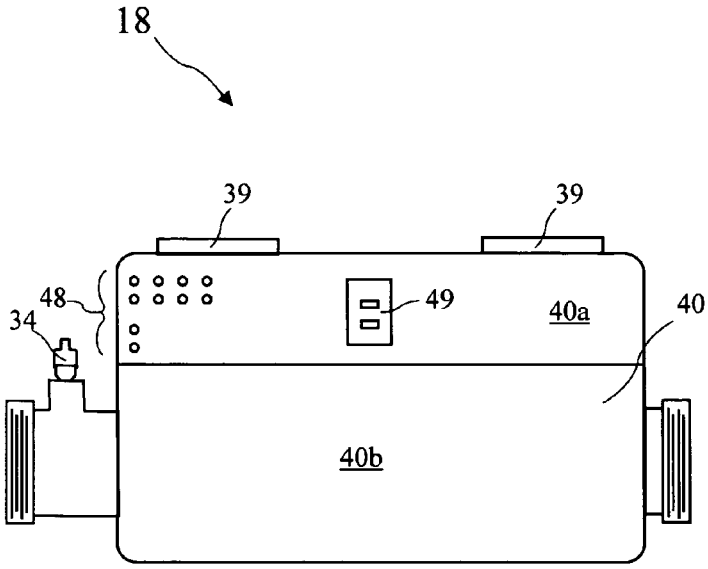
FIG. 2A is a front view of the spa heater/control.

A front view of the spa heater/control 18 is shown in FIG. 2A. The spa heater/control 18 according to the present invention includes spa control functions, and may alternatively be referred to as a spa controller. A heater/controller housing 40 includes a hinged and removable upper panel 40*a*, a removable lower panel 40*b* which may be removed to gain access to internal components of the spa heater/control 18, and a main housing portion 40*c* which the upper panel 40*a* and the lower panel 40*b* attach to. The upper panel 40*a* includes indicator lights 48 providing indications of failures an owner may provide to a technician, for example, over the phone or using email, thereby reducing repair time and costs. A Ground Fault Isolator (GFI) switch 49 may be accessed through the upper panel 40*a*, attached to the upper panel 40*a*, or may be installed at a main house circuit breakers or sub panel (using for example, a GFI circuit breaker), and is provided for sensing and resetting ground faults. Collector posts 51*a* electrically connect to current collectors 51 (see FIG.5) to capture current which might escape into the spa 10.

Figure 2B:
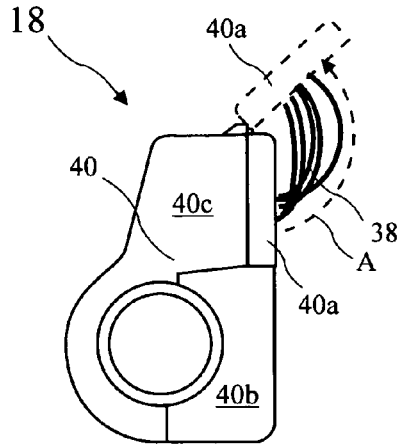
FIG. 2B is an end view of the spa heater/control.
Figure 7:
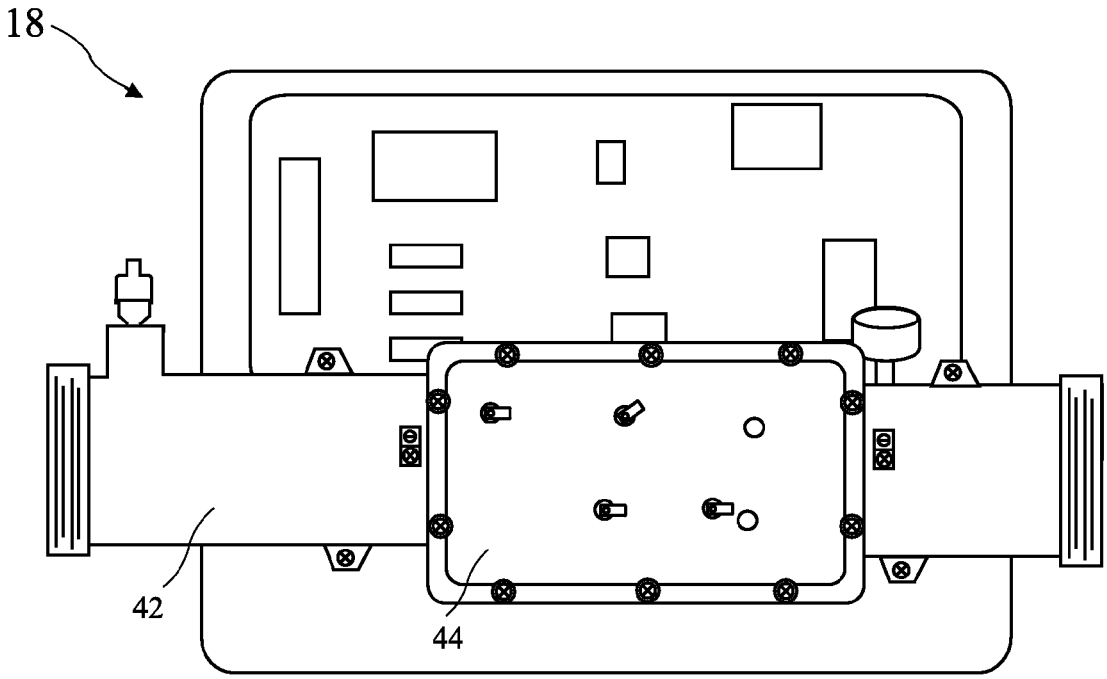
FIG. 7 shows a control circuit in the spa heater/control housing.
Figure 8:
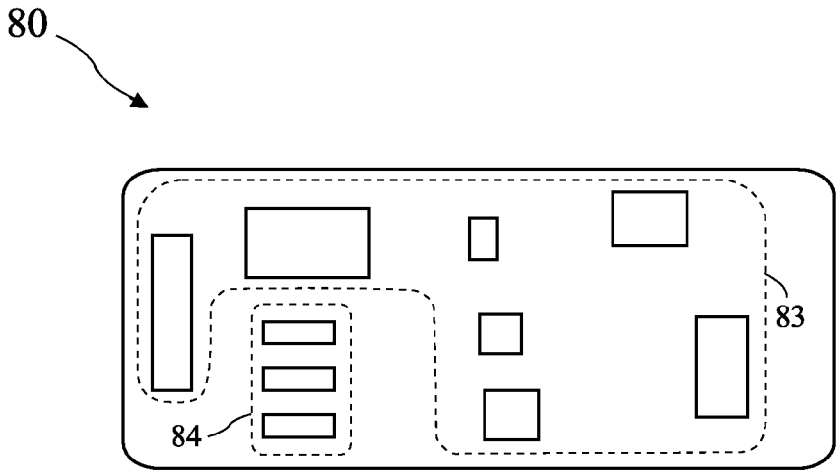
FIG. 8 shows the control circuit according to the present invention.

The upper panel 40*a* is shown opened along arc A using hinges 39 in FIG. 2B, with wires 38 connecting the indicator lights 48 to a control circuit 80 (see FIGS. 7 and 8).

Figure 3:
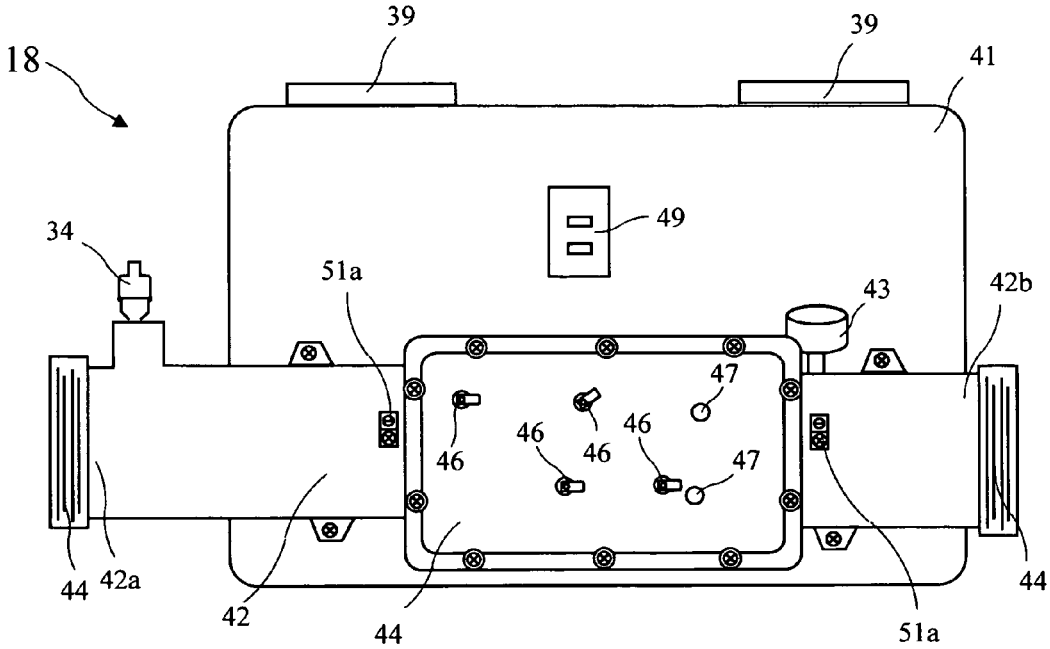
FIG. 3 is the spa heater/control with covers removed.

The spa heater/control 18 with the upper and lower panels 40*a* and 40*b* removed is shown in FIG. 3. The heater housing (also known as a heater manifold) 42 is mounted substantially horizontally in a heater/control housing 40 and is attached to the heater/control housing 40 by four screws, and generally resembles a cylinder or tube, approximately 19 inches long and approximately four inches in diameter. Heater posts 46 connect to heater elements 50 (see FIG. 5) to a manifold cover 44 resulting in the heater elements residing inside the heater housing 42. Two pairs of posts 46 connect to each heater element 50 and allow the heater to be wired for 110 VAC or 220 VAC. Sensor wells 47 extend into the heater housing 42 for temperature probes. A sensor 43 is attached to the heater manifold 42 to measure, for example, pressure.

Figure 4:
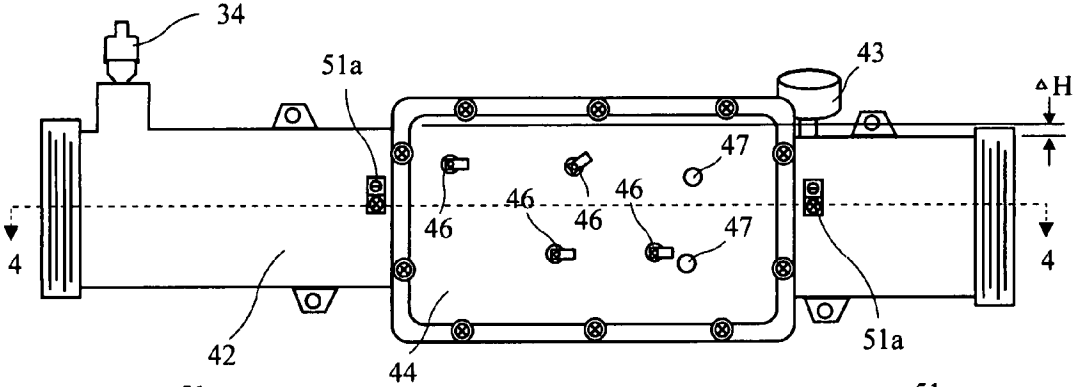
FIG. 4 is a heater manifold according to the present invention.

The heater manifold 42 is shown alone in FIG. 4 The heater manifold 42 is preferably shaped so that air will rise to one end of the heater manifold 42, and preferably to the end including the bleed-off valve 34. The inlet 42*a* is $\Delta_H$ higher than the outlet 42*b* to urge air towards the bleed-off valve 34. The height $\Delta_H$ is preferably 1/16 inch. Alternatively, the heater manifold 42 may be tapered to a smaller diameter going from the inlet 42*a* to the outlet 42*b*, thus providing for any air in the heater manifold 42 to migrate towards the bleed-off valve 34. Either tilting the heater manifold, or tapering the heater manifold removes air from the heater which air may otherwise cause overheating and damage the heater elements.

Figure 5:
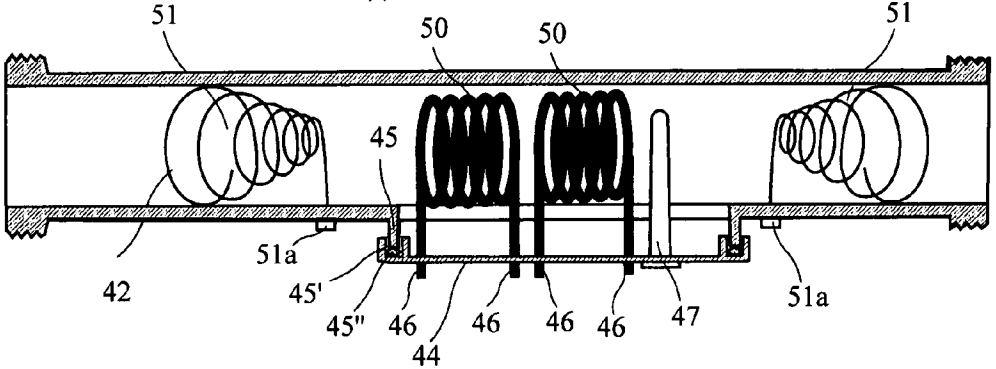
FIG. 5 shows heater elements according to the present invention.

One or two of the heater elements 50 may be connected through the manifold cover 44 as shown in FIG. 5, each heater element 50 is connected by the posts 46 which also provide electrical connections. Each heater element 50 may also be connected to the manifold cover 44 by two bolts. The manifold cover 44 mounts to a side of the heater manifold 42, preferably on a cover ridge 45 which resides in a cover groove 45' in the manifold cover 44. A cover O-ring 45" resides inside the cover groove 45' to seal the cover 44 to the heater manifold 42. The manifold cover 44 including the heater element(s) 50 is preferably secured to the heater manifold 42 by 10 machine screws to create a heater assembly. The heater assembly is secured to the interior of the heater/control housing 40 by 4 screws and as a result, the installation and the removal of the heater assembly and/or heater elements 50 is very easy in comparison to known spa heaters.

One or two current collector(s) 51 may be mounted inside the heater manifold 42. The current collectors 51 comprise a three dimensional helix both spiraling out radially from the center of the heater manifold and stretching axially in the heater manifold 42 (i.e., along the water flow through the heater manifold) as it spirals outward. The spiral comprises approximately five turns starting with an approximately 0.65 inch radius and extending radially to a final turn having an approximately two inch radius uncompressed, and is compressed to assemble inside the heater manifold 42. The smallest (center) spiral terminates in a radially extending straight segment approximately 1.7 inches long. The radially extending straight segment is terminated by welding to a ¼-20 316 stainless steel nut. The nut is attached to the collector post 51*a*. The current collectors 51 are preferable made from approximately 0.078 inch diameter 316 stainless steel wire. The spiral extends axially approximately 3.5 inches. The current collector 51 according to the present invention provides better current collection than a metal heater manifold (or any conductive manifold) and therefore has application to heaters with any type heater manifold.

The outer metal of the heating elements 50 is preferably Incoloy® metal. The Incoloy® metal is braised or welded to the post 46. The post 46 is then inserted through and preferably secured to the manifold cover 44 by a nut or nuts located on the electrical connecting side (or dry side) of the manifold cover 44.

The heater manifold 42 has a heater inlet 42*a*, and a heater outlet 42*b*. Threads 44 are provided on both the inlet 42*a* and the outlet 42*b* to connect to the spa plumbing using a typical union as shown in FIG. 6. The threads 44 are preferably 3 ½ inch threads. A prior art union is shown in a cross-sectional view taken along line 6-6 of FIG. 6 in FIG. 6A. The union comprises a threaded female nut 72 over a sleeve 70. One end of the sleeve is glued onto spa piping using PVC glue and the opposite end of the sleeve is connected by a nut to one end of the manifold. A union O-Ring 74 resides partially in a union O-Ring groove 76 on an end surface of the sleeve 70. The O-Ring is forced against the manifold edge by the nut 72 to create a water tight connection between the manifold 42 and the end of the sleeve 70.

Figure 6B:
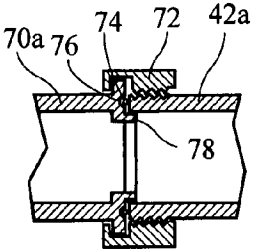
FIG. 6B is a cross-sectional view taken along line 6-6 of FIG. 5 of an improved union according to the present invention.
Figure 6A:
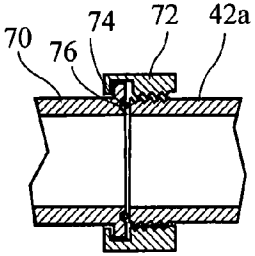
FIG. 6A (prior art)
FIG. 6A is a cross-sectional view taken along line 6-6 of FIG. 5 of a prior art union.
Figure 6:
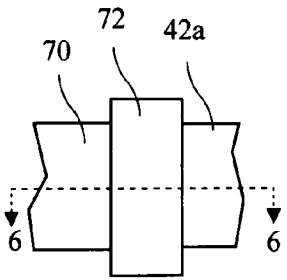
FIG. 6 is a union used to connect the spa heater/control to spa plumbing.

An improved union according to the present invention is shown in FIG. 6B in a second cross-sectional view taken along line 6-6 of FIG. 6. The improved sleeve 70*a* includes a guide 78 which enters the end of the heater manifold 42 to align the sleeve 70*a* with the heater manifold 42 thereby aligning the forward edge of the sleeve 70*a* to the manifold 42. The guide 78 also carries at least part of the load of the water pipes 20 and 24 (see FIG. 1) at the point of contact between the sleeve 70 and the manifold 42 thereby reducing the load carried by the nut 72 and reducing or preventing the chance of a water leak and/or a crack in the nut 72 which may result if the entire weight of the pipe 20 or 24 (or load due to misalignment) is carried by the nut 72.

A control circuit 80 is shown residing behind the heater manifold 42 in the housing 40 in FIG. 7, and the control circuit 80 is shown alone in FIG. 8. The majority of electrical components 83 of the spa heater/control 18 are mounted on the control circuit 80. The control circuit 80 is pre-assembled and provides an easy-to-remove assembly for repair and/or replacement. In case of an electrical failure in the field, a service technician may simply unscrew six screws to disconnect a main electrical connection, push the control circuit 80 approximately ½ inch toward the right, and remove the control circuit 80 from the housing 40. The reverse steps allow a new or repaired control circuit 80 to be installed, and a repair may thus be completed in a minimum amount of time and without the removal of the complete spa heater/control 18. The control circuit 80 includes a terminal block 84 for providing 120 volt or 220 volt poser to the spa heater/control 18.

Figure 9A:
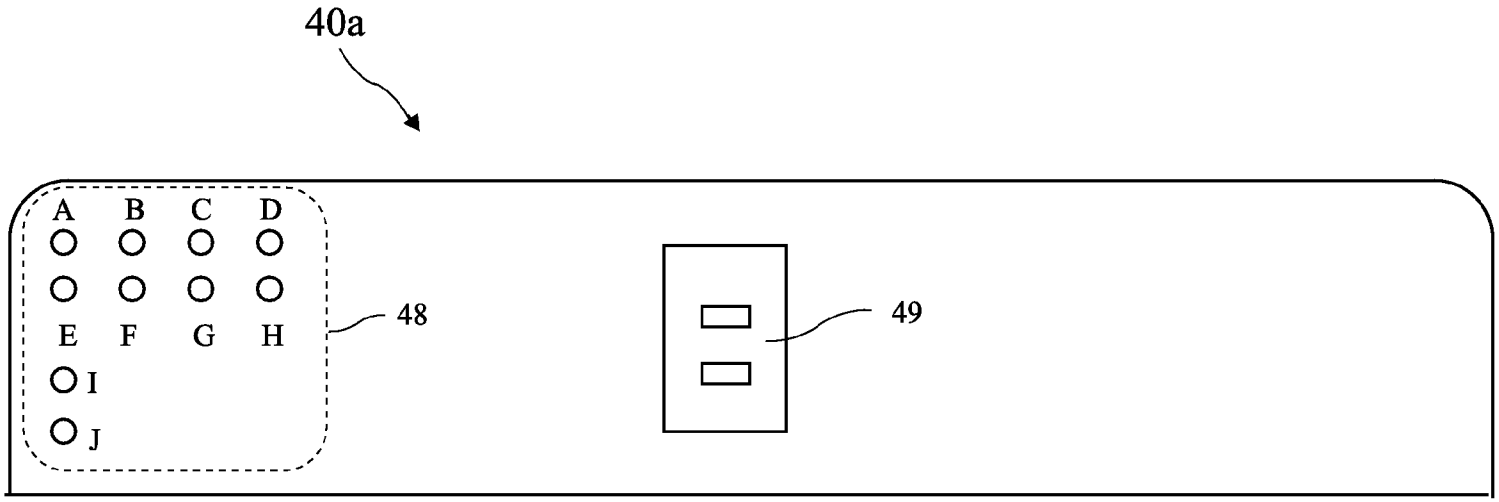
FIG. 9A is an upper electrical panel of a spa heater/control according to the present invention.

Details of the upper electrical panel 40*a* are shown in FIG. 9A. The upper electrical panel 40*a* includes indicator lights 48. The indicator lights 48 are marked A, B, C, D, E, F, G, H, I, & J. One purpose of the indicator lights 48 is to indicate if the spa heater/control 18 is receiving and/or correctly wired for 120 Volts and/or 240 Volts from a main electrical panel (e.g., circuit breakers). A predetermined pattern of the indicator lights 48 shows whether or not the electrician had properly installed line voltage to a main terminal block in the spa heater. In many cases, an electrician fails to properly connect 220 volt power to the spa heater, for example, L1 to Hot 1 Color Black (120 Volts ) to Neutral, L2 to Hot 2 Color Red (120 Volts) to Neutral, N to Neutral Color White (0 Volts) to Ground and G to Ground Color Green Light indicator A is connected to L1 and to Neutral on the three terminals (or the terminal block) 84 (see FIG. 8).

Circuits are provided to measure the voltage between the three terminals 84. If approximately 120 Volts is measured between L1 and Neutral, then light indicator A would come "ON" verifying that the circuitry is connected properly. This avoids the need for a volt meter to verify proper voltage, and whether or not indicator light A is "ON" or "OFF" may be provided to the spa dealer to determine whether the electrician made the proper connection or not.

Light indicator B indicates proper voltage between L1 and L2 on the main terminal block 84. For example, if 240 Volts is present between L1 & L2, then indicator light B would be "ON" and 240 Volts has been verified between L1 and L2 when the main power in "ON". If the indicator light B is "OFF" and this is an indication that 240 Volts has not been verified between L1 and L2, and the electrician may not have proper electrical connections to the main terminal block 84. This information may be provided to the spa dealer to save a trip to the residence.

Light indicator C is connected to a first pump electrical circuitry. Light indicator C "ON" indicates that voltage is going to the pump 14 (see FIG. 1) and the light C "OFF" indicates that the pump 14 is not operable and is an indication that the motor of the pump 14 is bad and needs to be changed. This knowledge allows the spa dealer to send a pump or pump motor with a repair man and save a second trip to the residence.

If a second pump is present in the spa 10, light indicator D indicates the operation of the second pump as described for the first pump above. Light indicators E, F, G, H, I, and J are all connected to other electrical accessories in the spa 10. Each indicator light is connected to determine if there is voltage going to that component or not. If there is voltage going to that component and the component is not "ON" then a failure is indicated for that particular component and that component needs to be serviced, repaired, and/or replaced. However, if the designated indicator light for a particular component is not "ON" then this is an indication that there is an error in the spa heater/control 18 circuitry and that circuitry needs to be repaired or replaced. The spa dealer at this level may send a technician with the proper part and change the bad component and only make one service trip instead of going back and forth multiple times. Further, often technicians may not have a volt meter available at a residence, and the technician with a volt meter may not be aware of where to measure voltages. Therefore, the indicator lights according to the present invention significantly reduce repair time and cost in many instances.

Figure 9B:
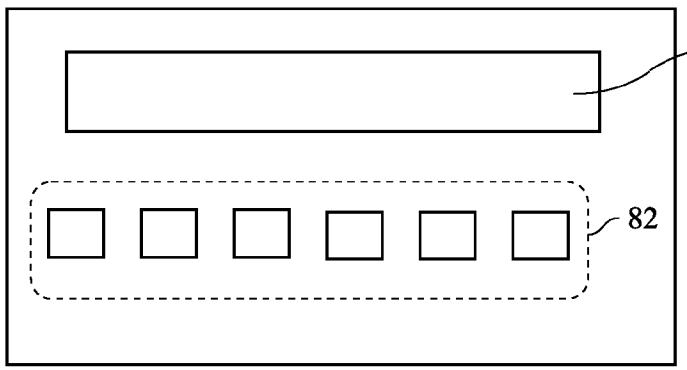
FIG. 9B is a spa side controller according to the present invention.

A top view of the spa-side control 11 is shown in FIG. 9B. The spa-side control 11 includes a spa owner observable display 81, and buttons 82 for controlling the spa, and is generally mounted on a top edge of the spa (see FIG. 1) for easy access to the buttons 82 and easy viewing of the display 81 (see FIG. 9B) by spa users. The buttons may also control special diagnostic functions. For example, two or more buttons may be held down to shift the display to a diagnostic mode, and one of the buttons may be pushed to cycle the display 81 through different measurements, for example, to display voltage measurements, amperage measurements, temperature measurements, and/or flow rate measurements.

The spa side controls 11 may further display information also displayed by the indicator lights 48. For example, the incoming voltage to the main terminal block 84. The voltage going to every spa heater/control 18 component may also be displayed when those components are set to be "ON". The spa-side control 11 may also display amperage reading for each component when a component is "ON". The amperage display helps determine if a particular component is good or is bad and allows a proper determination of what is wrong and what needs to be changed without a technician visit. For example, a spa owner may call the spa dealer and report a complaint that the spa 10 is not heating when the indicator light on the spa side control is "ON" (which means that a 5 Volt DC signal in the electronic circuitry indicates that the heater is "ON"). The spa dealer may ask the spa owner to scroll through the system and report if the spa-side control 11 is displaying that 240 Volts is going to the heater. If the spa-side control 11 indicates that there is 229 Volts showing on the display but there is no increase in water temperature, then the spa owner may scroll the display to a different function on the system and determine amperage going to the heater. If the amperage for the heater shows 0 amps, then the heater is defective. This trouble shooting of the system may be directed by the spa dealer over the phone with the spa owner without requiring a voltage meter or an amperage meter and without difficult operations.

Because the current draw by each component connected to the spa heater/control 18 is known, and the voltage and/or current that is consumed by each component may be displayed on the spa-side control 11, the current draw by a particular pump may also be displayed. The water flow of a particular pump may be computed in gallons per minute based on the flow curve for a particular pump in use, and the performance of the pump may thus be monitored.

Displaying the flow rate of a particular pump on the spa-side control 11 has many benefits for a trouble shooter over the phone. For example a spa owner may call the spa dealer and complain that the spa heater is not coming "On". The spa dealer may ask the spa owner to go to his spa-side control 11 and scroll through the functions until the flow indicators are displayed and when the pump is "ON". If the flow rate is 40 GPM but the particular pump model has a flow rate of 200 GPM, proper action may be directed, for example, cleaning the spa filter or fully open gate valves because the display indicated that there is an obstruction in the flow of the water and therefore the problem is plumbing related and not electrical. Monitoring flow and correcting such problems is important because the spa heater requires an adequate flow of water to avoid overheating, otherwise the heater may be ruined if the heater is on without the proper amount of water flowing through the heater.

The spa heater 10 may further include a safety switch that will prevent the heater from being "ON" when the flow rate is low. This may be used to prevent damage to the heater when the flow rate is low.

The control circuit 80 may further monitor the amperage drawn by a spa pump 14 (see FIG. 1) electrically connected to the control circuit 80. When the spa pump 14 is "ON" and pumping water, the water flow of the pump 14 is somewhat restricted by the spa plumbing. The spa plumbing generally includes main drain(s) 12*a* and 12*b* and a filter 13 which are connected to the suction side (vacuum side) of the pump 14, and spa heater/control 18 and jets 22 which are connected to the discharge side of the pump 14 (pressure side). In a matter of seconds after the pump 14 is turned "ON", the maximum water flow on this particular spa plumbing may be measured by the control circuit 80 and the actual maximum amperage drawn for the spa pump 14 may be measured and stored by the control circuit 80. If later, the measured amperage of the motor 14 experiences a sudden drop, the control circuit 80 may detect that the motor 14 is down loaded, which indicates a drop in water flow in the spa plumbing and that an obstruction exists on the suction side of the pump 14. Such obstruction may be due to a blockage on the main drains, and the pump 14 may immediately be switched "OFF" to avoid damage to the pump 14, or in some cases to prevent a child from being held against a drain.

For example, if the measured current drawn by the pump 14 in a particular spa plumbing is 10 amps under normal operation, the measured current draw of the pump 14 should remain with + or −10% (due to the AC line fluctuations) of this value when the pump 14 is "ON" on this particular spa. The expected current draw is stored in the control circuit 80. Then, at any time when the pump 14 is "ON", if the current draw drops substantially, for example, from 10 amps to 6 amps (i.e., an approximately 40 percent drop in current draw), the substantial drop is an indication that the pump 14 is not operating at the normal load that was measured and stored for this particular spa plumbing by the pump 14. The drop in current may indicate an obstruction in the flow path on the suction side of the pump 14 and that something, for example a child (or any person), is being sucked onto the main drain. The spa heater/control 18 may respond by turning the pump 14 (OFF) at least for a small period of time (for example, 5 minutes) and then after the period of time has elapsed, turning the pump 14 "On". If the same condition repeats itself multiple times (for example, 3 times) the pump 14 may be left off, and a message provided to the spa owner by the display 81 on the spa-side control 11 (see FIGS. 1 and 9B) to check plumbing obstructions before manually resetting the switch on the spa-side control 11 to turn the pump "On".

Figure 10:
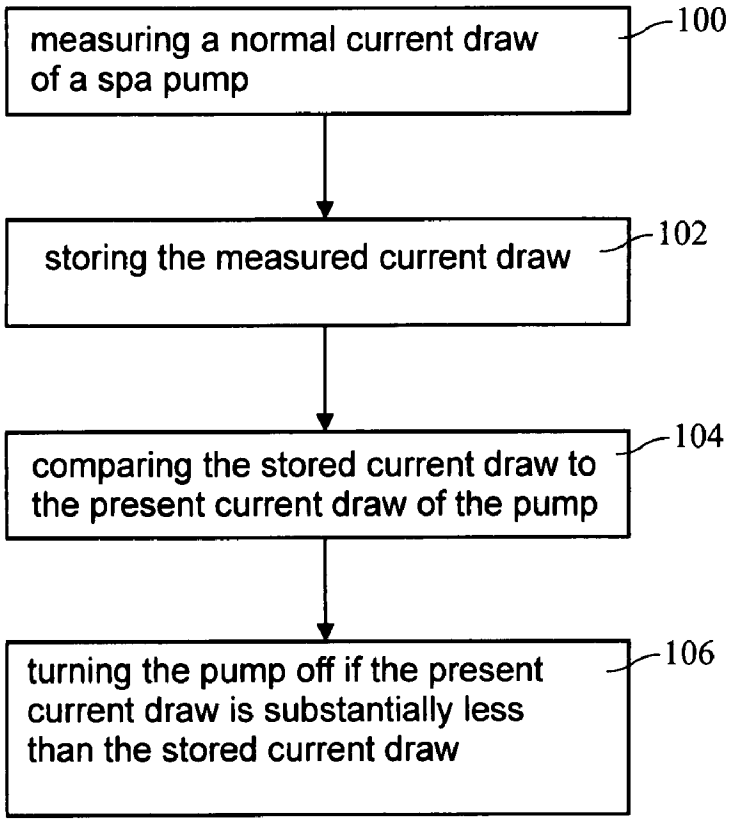
FIG. 10 is a method for detecting obstructions to spa drains according to the present invention.

A method for detecting obstructions to spa drains according to the present invention is described in FIG. 10. A normal current draw of a spa pump 14 is measured at step 100. The measured current draw is stored at step 102. The stored current draw is compared to a present current draw of the pump 14 at step 104. The pump 14 is turned off if the present current draw is substantially less than the stored current draw at step 106.

The spa-side control 11 is typically connected to a heater (gas, electric or solar) located inside a spa cabinet. The spa cabinet is totally enclosed and in many cases isolated from the outside ambient temperature. Inside the spa cabinet pumps, spa lights, electrical heater, ozone generator and other appliances may generate heat inside the spa cabinet. Known spa heaters use two temperature sensors (a thermistor type) inserted in the spa plumbing and electrically connected to a micro controller or micro processor located inside the electronic control box (in the case of the present invention, inside the spa heater/control 18). The only purpose of these two sensors is to monitor the water temperature in the spa plumbing and in the spa water. However, these two sensors do not have the capability, nor are they intended, to monitor the ambient temperature inside of the spa cabinet 28 (see FIG. 1). If the temperature inside the spa cabinet 28 rises over approximately 122 Degrees Fahrenheit, it could stop the motor from operation (the motor is supplied with a thermal overload that would open the motor electrical circuitry if the ambient temperature rises above the ambient temperature specified by the motor manufacturer (typically it is 122 Degree Fahrenheit) and a spa owner may call and complain to the spa dealer since the pump 14 is not operable. Generally, a spa repair man would come to the residence and change the motor even though the motor is not the problem, and the problem will repeat with the new motor, because neither the spa owner nor the service repair man know the ambient temperature inside the spa cabinet is the problem. The present invention adds an additional thermal sensor to the spa heater/control 18 to measure the temperature within the spa cabinet 28. Based on high spa cabinet 28 temperatures, the repair man or the spa owner may add air vents in the spa cabinet to solve the actual problem instead of changing motors.

A spa heater/control according to the present invention may further include Integrated Circuit (IC) temperature sensors in a spa, pool or hot tub application instead of thermistors, RTDs or thermocouples. The IC temperature sensor provides a much more accurate temperature measurement than sensors currently in use, for example, much more accurate than a thermistor made to communicate with a micro processor or with a micro controller.

IC temperature sensors are complete, silicon-based sensing circuits with either analog or digital outputs. Advantages of IC temperature sensors include a moderate temperature range (up to 150° C.), excellent linearity, built-in signal conditioning and comparators, and an optional addition of a digital interface. Another feature of IC temperature sensors is that they are complete temperature measurement packages. All required circuitry is built-in along with a variety of digital output formats to simplify the design in digital circuits. IC temperature sensors are available primarily in surface-mount temperature measurement packages or as simple IC temperature measurement packages which are approximately 3 mm square.

An example of a suitable temperature sensor is a Dallas DS1620S IC temperature sensor and bypass capacitor made by Maxim Integrated Products, Inc. in Sunnyvale, Calif. (both comprising surface-mount temperature sensor packages) mounted on a small PC board. The PC board is preferably potted in a thermally-conductive 3M waterproof epoxy along with its connecting cable. The temperature sensor package may be inserted into the sensor well 47 (see FIGS. 4 and 5) in the heater manifold 42 to provide continuous water temperature readings.

As described above, since the sensor is an IC temperature measurement package, all of its support circuitry is internal to the chip (with the exception of the power bypass capacitor). The only signals that need to be provided to the sensor is a 5V power signal and a ground, and 3 digital signals (data in/out, data clock, and chip select). The outputs from the temperature sensor package is a binary number (on the data in/out line) with 1111111111b=−0.5° C., 0b=0° C., 1b=0.5° C., 2b=1.0° C., etc. and three thermostat signals which may be optionally used as needed. A LOW thermostat signal (the LOW temperature signal goes high when the sensor measures a temperature BELOW a programmed low temperature value) may be used to signal a freeze guard function to go active.

The spa heater/control 18 according to the present invention may include up to three Dallas DS1620S or DS1720S IC temperature sensors and bypass capacitors (both surface-mount packages) mounted on small PC boards (all three will be the same). Each board is preferably potted in a thermally-conductive waterproof epoxy along with their connecting cables. Two of the temperature measurement packages may be inserted into the sensor wells 47 in the heater manifold 42. These two provide continuous water temperature readings, as well as provide low temperature and OverLimit high temperature signals. The third temperature measurement package may be mounted/hung outside the housing 40 and monitors the ambient air temperature surrounding the heater/control 18.

An advantage of using the IC temperature sensors is that the sensors may be calibrated after connecting cables and potting them with the epoxy. The calibration required was to adjust for the thermal drift due to the PC board and epoxy insulating the sensor from water or air. The calibration allows for a small +/−2.5° C. adjustment that the spa owner may make to adjust for their individual installation.

The spa heater/control 18 according to the present invention may further include a programmable processor which may automatically monitor the total amperage drawn by each component connected to the spa heater and not over load the main circuit breaker installed by the electrician. Typical electrical service provided by the spa owner to the spa is 60 Amps at 240 VAC. During installation the electrician inputs the available current to the programmable processor. The maximum amperage load allowed by a spa controller may be, for example, 48 Amps. The spa heater/controller 18 (for example, a micro processor in the spa heater/control 18) may compare the total amperage available for spa operation to a sum of the amperages used by each component, obtained by amperage sensors as described above. The micro processor may be programmed to shut off the unnecessary or non essential functions within the spa system based on the measured current draw of each component and not overload the main circuit breaker provided by the spa electrical service and provide an optimal use of the available current input by the electrician. For example, a second pump, second heater, and/or blower may be turned off if the measured amperage is high.

The spa heater/control 18 according to the present invention may further include automatic disconnection of faulty electric heater(s) elements 50 (see FIG. 4) from the electrical circuitry. Known spa controls are protected by Ground Fault Circuit Interrupter (GFCI) per National Electrical Code and by UL STD 1563. The GFCI electrically protects all components in the spa including the heater(s). If one of the heating elements 50 is detected to have a fault to ground, the GFCI will trip and disconnect all electrical power from the main circuitry to the control box. As a result of the total disconnection, nothing in a spa having known controls will remain operable including the circulating pump which provides the filtrating cycle as well as protecting the spa from freezing. If the consumer is not aware of the electrical power interruption to the spa, the spa may freeze if the spa is located in a freezing environment.

The spa heater/control 18 according to the present invention includes electronic circuitry to solve the spa freezing problem. The micro processor (or controller) in the spa heater/control 18 may be set to monitor the current to ground. The GFCI trips when the ground potential short rises to an unsafe level, for example, 4 to 6 milliamps. The spa heater/control 18 may monitor the heating elements 50 current usage and remove power from the heating elements 50 before the GFCI trips (e.g., before the ground potential short reaches 4 to 6 milliamps or before the GFI responds to a high current, typically requiring 0.03 seconds.

More specifically, a ground current collected by the current collectors 51 (see FIG. 5) is measured by a current sensing circuit in the spa controller. If the current sensing circuit detects the ground current rising to approximately 2 to 3 milliamps, then a heater short shutdown is initiated and the controller arms. When armed, the controller watches to see if current to ground continues to rise above approximately 3 milliamps. If the current to ground continues to rise and if it reaches 3.5 milliamps (still below the triggerable level of the GFCI) the controller is programmed to turn off the heater relay, thereby opening the electrical circuits providing power to the heater element(s) 50 and shutting down the heater element(s) 50 only.

Typical GFCIs trip at 4 to 6 milliamps within two to three hundredths of a second (0.03 seconds). The controller operates at an average clock speed of one millionths of a second (0.000001s) with an average current sampling rate of two thousandths of a second (0.002s). At these clock speeds, the controller is able to read the current leakage to ground eight times before the GFCI will trip. In order to insure proper behavior when the system is installed, the controller may include a diagnostic installation mode. In such diagnostic mode, the GFCI is manually tripped to allow the controller to learn the behavior of it's particular GFCI.

Figure 11:
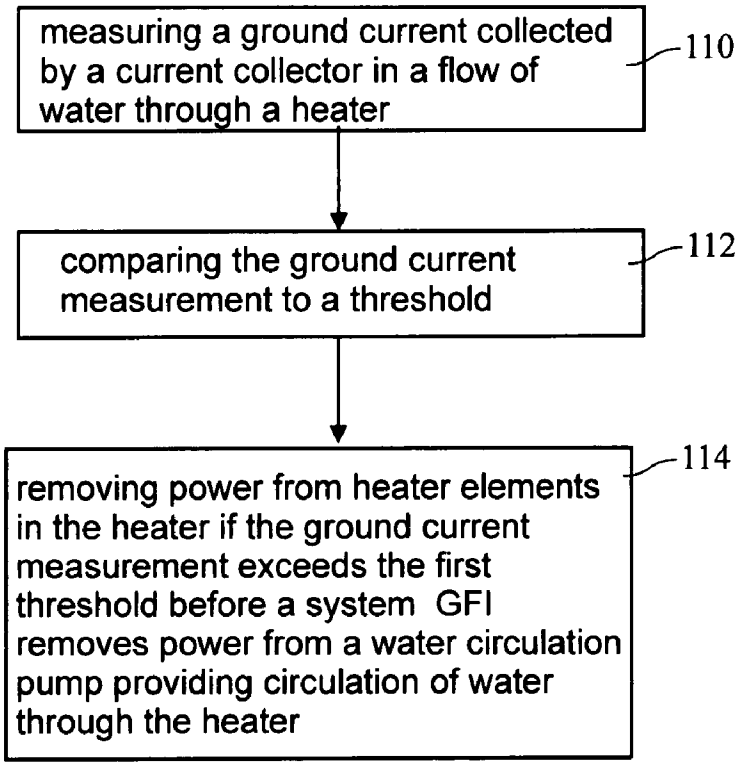
FIG. 11 is a method for responding to ground currents according to the present invention.

A method for responding to ground currents according to the present invention is described in FIG. 11. A ground current is collected by a current collector in a flow of water through a heater at step 110. The ground current measurement is compared to a threshold at step 112. Power is removed from heater elements in the heater if the ground current measurement exceeds the first threshold before a system GFI removes power from a water circulation pump providing circulation of water through the heater at step 114.

Although the present invention has been described as a spa heater including spa control functions, the measuring, processing, and control functions described above may be included in a spa controller which is separate from a spa heater, and a spa controller including the functions described above is intended to come within the scope of the present invention.

While the invention herein disclosed has been described by means of specific embodiments and applications thereof, numerous modifications and variations could be made thereto by those skilled in the art without departing from the scope of the invention set forth in the claims.

I claim:

1. A spa ground current detector comprising:

a heater assembly including a heater manifold and heater elements inside the heater manifold for heating a flow of water through the heater manifold;

at least one current collector residing in the center of the flow of water and comprising a three dimensional helix both spiraling out radially from the center of the heater manifold and stretching axially as it spirals outward;

a control circuit electrically connected to the heater assembly;

a current sensing circuit in the control circuit, the current sensing circuit measuring a ground current collected from the flow of water by the at least one current collector;

a comparing circuit comparing the measurement of the ground current to a first threshold for detecting an excessive ground current.

2. A method for controlling a spa heater, the method comprising:

measuring a ground current collected by a current collector in a flow of water through a heater, the current collector spiraling radially out from the center of the flow of water;

comparing the ground current measurement to a first threshold; and removing power from heater elements in the heater if the ground current measurement exceeds the threshold before a system Ground Fault Isolator (GFI) removes power from a water circulation pump providing circulation of water through the heater.

3. The method of claim 2, wherein comparing the ground current measurement to a first threshold comprises comparing the ground current measurement to approximately 3.5 milliamps.

4. A spa ground current detector comprising:

a spa Ground Fault Isolator (GFI) circuit for comparing current in a hot wire with current in a neutral wire to detect ground faults and shut down the spa;

a heater assembly including a heater manifold and heater elements inside the heater manifold for heating a flow of water through the heater manifold;

at least one current collector independent of the spa GFI circuit and residing in the flow of water;

a control circuit electrically connected to the heater assembly;

a current sensing circuit in the control circuit, the current sensing circuit measuring a ground current collected from the flow of water by the at least one current collector;

a comparing circuit comparing the measurement of the ground current to a ground current threshold for detecting an excessive ground current for shutting down the heater assembly before the GFI shuts down the spa.

5. the spa ground current detector of claim 4, wherein the at least one current collector spirals out from the center of the flow of water.

6. the spa ground current detector of claim 5, wherein the at least one current collector comprises two current collectors spiraling out from the center of the flow of water.

7. the spa ground current detector of claim 6, wherein the at least one current collector comprises two three dimensional helix current collectors both spiraling out radially from the center of the flow of water and stretching axially as they spiral outward.

8. the spa ground current detector of claim 7, wherein the current collectors reside inside the heater manifold.

9. A method for controlling a spa heater, the method comprising:

measuring a current difference between a first current on a hot wire and a second current on a neutral wire using a Ground Fault Isolator (GFI);

tripping the GFI when the current difference exceeds a GFI threshold thereby turning off a spa pump;

heating a flow of water through an electric spa heater;

measuring a ground current collected by a current collector in the flow of water;

comparing the ground current measurement to a ground current threshold; and removing power from heater elements in the heater if the ground current measurement exceeds the ground current threshold before the GFI removes power from the spa pump.

10. The method of claim 9, wherein measuring a ground current collected by a current collector comprises measuring the ground current collected by a current collector spiraling radially out from the center of the flow of water.

11. The method of claim 10, wherein measuring a ground current collected by a current collector comprises measuring the ground current collected by a current collector comprising two current collectors spiraling radially out from the center of the flow of water.

12. The method of claim 10, wherein measuring a ground current collected by a current collector comprises measuring the ground current collected by a current collector comprising two current collectors spiraling radially out from the center of the flow of water and residing in a heater manifold.

* * * * *